United States Patent [19]

Mise et al.

[11] 4,297,146

[45] Oct. 27, 1981

[54] METHOD FOR THE PRODUCTION OF POWDERED DEXTROSE

[75] Inventors: Yoshinari Mise, Inagi; Eijiro Tomimura, Tokyo, both of Japan

[73] Assignee: CPC International Inc., Englewood Cliffs, N.J.

[21] Appl. No.: 729,325

[22] Filed: Oct. 4, 1976

[51] Int. Cl.[3] ..... C13F 1/02; C13F 3/00

[52] U.S. Cl. ..... 127/60; 127/30; 127/61

[58] Field of Search ..... 127/29, 30, 58, 60, 127/61

[56] References Cited

U.S. PATENT DOCUMENTS

| | | | |
|---|---|---|---|
| 2,324,113 | 7/1943 | Schopmeyer | 127/30 |
| 3,085,914 | 4/1963 | Wadsworth et al. | 127/30 |
| 3,197,338 | 7/1965 | Hurst et al. | 127/60 X |
| 3,257,665 | 6/1966 | Idaszak | 127/58 |
| 3,650,829 | 3/1972 | Walon | 127/60 |
| 3,748,175 | 7/1973 | Kawamura et al. | 127/60 |
| 4,059,460 | 11/1977 | Schollmeier et al. | 127/29 |

OTHER PUBLICATIONS

*Handbook of Chemistry and Physics,* 17th ed. Cleveland, Chemical Rubber Co., 1966, p. C-336.

*Hackh's Chemical Dictionary,* 4th ed. N.Y., McGraw-Hill, 1969, p. 300.

Whistler, R. L. *Starch: Chemistry and Technology.* N.Y., Academic Press, 1967, Chapter 24, pp. 553-555, by Kooi, E. R. and Armbruster, F. C., *Production and Use of Dextrose.* TP415W4C.3.

*Primary Examiner*—Frank W. Lutter

*Assistant Examiner*—Roger F. Phillips

[57] ABSTRACT

A method for the production of an anhydrous powdered dextrose containing large amounts of anhydrous crystals of $\beta$-form dextrose, characterized by concentrating aqueous solutions of dextrose, or aqueous solutions containing dextrose up to a sugar concentration of 90 to 98%, adding anhydrous crystals of $\beta$-dextrose or powdered dextrose containing large amounts of anhydrous $\beta$-dextrose as seed crystals to this concentrate at temperatures above 60° C., maintaining the temperature above 60° C., and while stirring gently, eliminating the free water by vacuum dehydration from the time of formation of microcrystals by adequately reducing the pressure.

8 Claims, No Drawings

METHOD FOR THE PRODUCTION OF POWDERED DEXTROSE

BACKGROUND OF THE INVENTION

This invention relates to a method for the production of an anhydrous powdered dextrose which contains large amounts of anhydrous β-dextrose from aqueous dextrose solutions or from aqueous solutions containing dextrose.

It is known that there are three types of crystals in dextrose, anhydrous α-dextrose crystals, monohydrate α-dextrose crystals and anhydrous β-dextrose crystals. Of these, the anhydrous β-dextrose has the advantages of having a more rapid rate of dissolution, better solubility in cold water and showing less caking phenomenon during dissolution compared to the monohydrate and anhydrous α-dextroses. The anhydrous β-dextrose also has the further advantage over the monohydrate dextrose that it can be utilized to avoid the problem of moisture content, whereas the monohydrate dextrose has a moisture content of about 9% in the form of crystalline water.

To date, the crystallization methods used for dextrose have been classified as the boiling method, whereby crystals are formed under the condition of a moderate degree of supersaturation and the crystals are centrifugally separated from the formed massecuite, and the total sugar method, whereby separation is not done and the total solid fraction is taken from the sugar solution as the product.

The boiling method yields a highly pure product, but due to the immense investment in equipment, the low yield, the long time required, etc., the production costs are quite large. On the other hand, in the total sugar method, the caking and grinding process, the spray-drying process, etc., must be carried out. This encounters problems in the caking and grinding process such as a long time being required for the caking operation, and the powder becomes sticky during the grinding operation and adheres to the mill, etc. Furthermore, although various spray-drying processes exist, they generally have the problems of requiring large amounts of dry seed crystals, curing equipment for after the spraying, etc. Also, in the total sugar method, there has been difficult to treate the free water during the crystallization.

Regarding the production of anhydrous β-dextrose, processes utilizing the boiling method have been known; for example, Japanese Patent Specification No. SHO 46-25690, but no processes based on the total sugar method have yet been available for the simple and easy production of anhydrous powdered dextrose containing large amounts of anhydrous β-dextrose.

The prior art processes also include Japanese Patent Specification No. SHO 37(1962)-30377 which discloses a sugar crystallization process wherein a sugar solution heated through a long pipe is spouted into a vacuum evaporator and then air is blown into the sugar concentrate which has about 9% water content and is sedimented on the bottom of the evaporator, thereby crystallizing the concentrate by convection; and Japanese Patent Specification No. SHO 36(1961)-25250 which discloses a process for the production of crystalline dextrose wherein a dextrose solution is concentrated to a point where the water content is less than 9%, and then the concentrate is introduced into a closed vessel with an agitator and strongly agitated to form crystals by mixing the concentrate with air.

SUMMARY OF THE INVENTION

This invention includes an apparatus and process of the total sugar method wherein the sugar solution is powdered while the free water is removed during crystallization.

The present invention is characterized in that aqueous solutions of dextrose, or aqueous solutions containing dextrose are concentrated up to sugar concentrations of 90 to 98%. This concentrate is kept at about 60° C. or above and anhydrous β-dextrose, or powdered dextrose containing large amounts of β-dextrose, is added as seed crystals. The temperature is maintained above about 60° C. and while stirring gently, vacuum dehydration is done under sufficiently reduced pressure from the time of formation of microcrystals. Thus, this method yields an anhydrous powdered dextrose containing large amounts of anhydrous β-dextrose.

DETAILED DESCRIPTION OF THE PREFERRED EMBODIMENTS

The aqueous dextrose solutions or the aqueous solutions containing dextrose which are to be used as starting materials in the process of this invention may include a variety of materials. For example, various starches such as sweet potato starch, potato starch, wheat starch, corn starch, etc., can be saccharified with an acid-enzyme or an enzyme-enzyme saccharification process to give saccharified starch solutions and various dextrose-containing solutions may be obtained from these saccharified starch solutions. Furthermore, the various purified and partially purified solid dextroses obtained from these can be redissolved in water to give aqueous dextrose solutions which may serve as the starting material.

These aqueous dextrose solutions or aqueous solutions containing dextrose can be used as is but it is also possible to employ them after refining them using conventional methods such as with activated carbon or ion exchange resins, etc.

The refined or unrefined dextrose solutions are then concentrated up to a sugar concentration of about 90 to 98%, preferably about 94 to 98%, using ordinary methods and concentrating equipment such as multi-effective evaporators, or thin-layer film evaporators, etc. This concentration is generally performed under conditions of heating with reduced pressure. From the viewpoints of operating time and work ability, it is preferable that the sugar concentration not surpass about 98%.

The concentrated sugar solution is next introduced into a kneader which has preheated to a temperature above about 60° C., for example 90° to 95° C., and stirred at a temperature above about 60° C.

The kneader is a stirrer which it is possible to control the temperature at high temperatures. The action take a soft mass containing microcrystals and kneads and pulverizes the mass finally making it a powder. Any apparatus which is equipped for vacuum dehydration can be used for this process.

The initial stirring rate should be such that it can quickly bring about a homogeneous blending of the seed crystals and the sugar solution, and can also break down the pliable fondant-like mass which contains the microcrystals which tend to form after seed inoculation. For example, stirring at about 2 to 10 rpm is preferable. The stirring rate should then be adjusted according to the condition of the contents of the kneader. It is best to use a faster stirring rate for blending of the seed crystals and the sugar solution after inoculation, a gentler stirring as the viscous resistance increases in the fondant-like mass between the time of the micro-crystal formation and the time of powder formation, and again at a faster rate during the drying process following powder formation with its increase in flowability.

The sugar solution in the kneader is kept at a temperature above about 60° C. and seed crystals of anhydrous β-dextrose, or powdered dextrose containing a large amount of β-dextrose are added. These seed crystals should be no larger than about 100 mesh. The percentage of anhydrous β-dextrose contained in the seed should be above about 85%, preferably above about 90%. It is also possible to use the powdered anhydrous dextrose obtained by the method of this invention as the seed crystals and from the viewpoints of its effect as the seed and its economics, it is convenient to do so.

The quantity of seed crystals utilized must be at least about 0.2% based on the solids content of the sugar solution. However, it is preferable if the quantity of seed crystals be at least about 10%. Of course, substantially larger quantities may be used but there is no particular advantage in doing so.

In the method of this invention the crystallization degree of the anhydrous β-dextrose is affected by the temperature at which the crystallization takes place. For example, when anhydrous β-dextrose was used as the seed, the content of anhydrous β-dextrose in the product was 93% at 97° C., 89% at 90° C., 85% at 80° C. and 59% at 40° C. In this way, it is possible to vary the crystallization degree of anhydrous β-dextrose by varying the operating temperature. The material should be kept at about 60° C. or higher to obtain crystals having a commercially significant percentage of β-dextrose. It is preferred that the temperature be kept at about 80° C. or higher, most preferably at about 90° C. or above.

The formation of the crystals generally begins shortly; i.e., about 10 minutes after the seed crystals are added. The mass becomes a pliable fondant-like mass containing white micro-crystals. Furthermore, the formation of the micro-crystals causes the free water to increase correspondingly to the amount of crystals formed, and therefore, the concentration of the sugar solution decreases.

The free water produced should be suitably removed by dehydration under adequately reduced pressure. In this way, by continuously carrying out the formation of the micro-crystals, the generation of free water, and the dehydration of the free water, the water fraction is gradually removed and at the same time the material itself becomes crystalline and is changed into a solid powder.

The reduced pressure must merely be adequate to remove the free water. It is preferable that the reduced pressure utilized be such that no material decrease in temperature of the mass takes place through the sudden evaporation of a large amount of free water. For example, at 90° to 95° C., 200 to 250 mm Hg pressure (abs) is appropriate. When a much lower pressure than this is used during the initial stage, the temperature will drop and the anhydrous β-dextrose crystallization degree will decrease. At this heating temperature of 95° C., a sugar solution concentration of 94% and a reduced pressure of 200 mm Hg (abs), the material temperature will be maintained at 93° C. However, if the pressure is reduced beyond this, the material temperature begins to decrease. When the heating temperature is 95° C. and the sugar concentration is 96%, a pressure of 100 mm Hg (abs) results in the material temperature beginning to drop from 93° C. Therefore, from the relationship of the sugar solution concentration and the temperature to the reduced pressure used to eliminate the free water, it is necessary to avoid any abrupt operation by selecting a suitable reduced pressure.

The removal of the free water is continued until substantially all of the dextrose has crystallized. Generally, this will take less than about one-half hour. The stirring action of the kneader causes the dehydrated mass to become a flowable powder.

It is preferred for improved product stability that the product be further dried under reduced pressure. The pressure is further reduced and by adequately drying, the flowability is further improved. The reduced pressure at this stage is 50 to 100 mm Hg (abs) or lower, and finally it is reduced to 20 mm Hg (abs) or less. In this way, a free-flowing anhydrous powdered dextrose is obtained which contains a large amount of anhydrous micro-crystalline β-dextrose having a moisture content of about 0.5 to 1% or less.

The method of this invention produces crystals of powdered dextrose which are micro-crystals since the crystallization is done under conditions of very high sugar concentration; i.e., 90 to 98%. For this reason, compared to the products of other crystallization methods such as the boiling process, the powdered dextrose of this invention has a larger surface area and exhibits a faster rate of dissolution.

In order to provide a better understanding of this invention, the following exemplary and non-limiting examples are provided.

EXAMPLE I

Commercial anhydrous dextrose was dissolved in water and concentrated to 96% in a concentrator at 90° C. This was then transferred to and stirred at about 5 rpm in a kneader maintained at 90° C. and equipped with temperature control and vacuum dehydration devices. Next anhydrous dextrose was ground to about 100 mesh, preheated to 90° C. and added to the concentrated sugar solution in the above kneader at 0.2% relative to the solid fraction of said concentrated sugar solution. After about 10 minutes, when the whole solution had become a white, pliable, fondant-like mass, it was vacuum dehydrated at about 200 to 250 mm Hg (abs). After about another 10 minutes, when this had become a white micro-crystalline powdery state, the pressure was further reduced to about 100 mm Hg (abs). After an additional lapse of about 5 minutes, when the flowability of the powder had increased, the pressure was lowered to about 20 mm Hg (abs) or less and it was further dehydrated to a moisture content of 0.5% or lower.

Measurement of the optical rotation of the powdered dextrose obtained in this way indicated that it contained about 92% anhydrous β-dextrose

EXAMPLE II

Commercial anhydrous dextrose was dissolved in water and concentrated up to 96% in a concentrator at 90° C. This was then transferred to and stirred at about 5 rpm in a kneader maintained at 90° C. and equipped with devices for temperature control and vacuum dehydration. Next the microcrystalline powder obtained in Example I was ground to about 100 mesh and this was added to concentrated sugar solution in the kneader at 0.2% relative to the solid fraction of the said solution. After about 10 minutes, when the whole solution had become white, pliable, fondant-like mass, it was vacuum dehydrated at about 200 to 250 mm Hg (abs). After an additional lapse of about 10 minutes, when this had become a white micro-crystalline powdery state, the pressure was reduced to about 100 mm Hg (abs). After about another 5 minutes, when the flowability of the powder had increased, the pressure was lowered to about 20 mm Hg (abs) or less and it was further dehydrated.

The powdered dextrose obtained in this way had a moisture content of 0.5% and contained about 90anhydrous β-dextrose.

EXAMPLE III

Commercial corn starch was digested with commercial enzyme preparations to give a saccharified starch solution (DE 95.5). This was then refined with active carbon and an ion exchange resin using standard techniques, and concentrated up to 96% in a concentrator at 95° C. This concentrated solution was then transferred to a kneader maintained at 95° C. and which was equipped with devices for temperature control and vacuum dehydration. Next anhydrous β-dextrose was ground to about 100 mesh and added to the concentrate sugar solution in the above kneader at 10% relative to the solid fraction thereof. After about 10 minutes, when the whole solution had become white, pliable, fondant-like mass, it was vacuum dehydrated at about 200 to 250 mm Hg (abs). After about another 10 minutes, when this had become a white powdery state, the pressure was decreased to about 100 mm Hg (abs). Following about another 5 minutes, when the flowability of the powder had increased, the pressure was lowered to about 20 mm Hg (abs) or less and it was further dehydrated.

The powdered dextrose obtained in this way had a moisture content of 0.5% and contained about 89% anhydrous β-dextrose.

EXAMPLE IV

Commercial corn starch was digested with commercial enzymes to give a saccharified starch solution (DE 95.5). This was then refined with active carbon and an ion exchange resin using standard techniques, and concentrated up to 96% in a concentrator at 95° C. This concentrated solution was then transferred to a kneader maintained at 95° C. and which was equipped with devices for temperature control and vacuum dehydration. Next the powdered dextroe obtained in Example 3 was ground to about 100 mesh and added to the concentrated sugar solution in the above kneader at 10% relative to the solid fraction thereof. After about 10 minutes, when the whole solution had become a white, pliable, fondant-like mass, it was vacuum dehydrated at about 200 to 250 mm Hg (abs). After about another 10 minutes, when this had become a white micro-crystalline powdery state, the pressure was reduced to about 100 mm Hg (abs). When the flowability of this powder had increased following about another 5 minutes, the pressure was lowered to about 20 mm Hg (abs) or less and it was further dehydrated.

The powdered dextrose obtained in this way had a moisture content of 0.5% and contained about 80% anhydrous β-dextrose.

EXAMPLE V

Commercial corn starch was digested with commercial enzymes to give a saccharified starch solution (DE 95.5). This was then refined with active carbon and an ion exchange resin using standard techniques, and concentrated up to 96% in a concentrator at 95° C. This concentrated solution was transferred to a kneader maintained at 95° C. and which was equipped with devices for temperature control and vacuum dehydration. Next the powdered dextrose obtained in Example 3 was ground to about 100 mesh and added to the concentrated sugar solution in the above kneader at 10% relative to the solid fraction thereof. After about 10 minutes, when whole solution had become a white, pliable, fondant-like mass, it was vacuum dehydrated at about 200 to 250 mm Hg (abs). After about another 10 minutes, when this had become a white micro-crystalline powdery state, the pressure was reduced to about 50 mm Hg (abs) or less and the dehydration was continued.

The powdered dextrose obtained in this way had a moisture content of 0.5% and contained about 88% anhydrous β-dextrose.

EXAMPLE VI

A DE 98 sugar solution obtained by enzymatic saccharification of corn starch was treated by standary crystallization techniques. After the crystals were removed, the residual No. 1 molasses was refined with active carbon and an ion exchange resin using standard techniques, and concentrated up to 96% in a concentrator at 95° C. This concentrated solution was then transferred to a kneader maintained at 95° C. and which was equipped with devices for temperature control and vacuum dehydration. Next the powdered dextrose obtained in Example 3 was ground to about 100 mesh and added to the concentrated sugar solution in the above kneader at about 10% relative to the solid fraction thereof. After about 10 minutes, when the whole solution had become white, pliable, fondant-like mass, it was vacuum dehydrated at about 200 to 250 mm Hg (abs). After about another 10 minutes, when this had become a white micro-crystalline powdery state, the pressure was decreased to about 100 mm Hg (abs). When the flowability of this powder had increased following about another 5 minutes, the pressure was lowered to about 20 mm Hg (abs) or less and it was further dehydrated.

The powdered dextrose obtained in this way had a moisture content of 0.5% and contained 84% anhydrous β-dextrose.

While the invention has been described in connection with specific embodiments thereof, it will be understood that it is capable of further modification, and this application is intended to cover any variations, uses or adaptions of the invention following, in general, the principles of the invention and including such departures from the present disclosure as come within the known or customary practice in the art to which the invention pertains and as may be applied to the essential features hereinbefore set forth, and as fall within the scope of the invention.

What is claimed is:

1. A method for the production of powdered dextrose containing a substantial portion of anhydrous β-dextrose from an aqueous solution containing dextrose comprising the steps of:

(a) concentrating said solution containing dextrose to a concentration of within the range of about 90% and about 98%, by weight dry substance;

(b) introducing into said concentrated solution at least about 0.2%, by weight of sugar, of seed crystals containing β-dextrose at a temperature above about 80° C.; and (c) vacuum dehydrating said concentrated solution with stirring while maintaining said temperature above about 80° C. to remove free water.

2. A method in accordance with claim 1, wherein said solution containing dextrose is a saccharified starch solution.

3. A method in accordance with claim 1, wherein said temperature is maintained above about 90° C.

4. A method in accordance with claim 1, wherein said solution is concentrated to be in the range of from about 94% to about 98%, by weight, dry substance.

5. A method in accordance with claim 1, wherein the amount of said seed crystals are at least about 10%, by weight dry substance.

6. A method in accordance with claim 1, wherein said seed crystals are a powdered dextrose material containing at least about 85% anhydrous β-dextrose.

7. A method in accordance with claim 1, wherein said vacuum dehydration is carried out by reducing the pressure to the range of about 200 to 250 mm Hg (abs) and maintained for a period of time until substantially all of the dextrose has crystallized.

8. A method in accordance with claim 7, wherein said vacuum dehydration is further carried out by further reducing the pressure to the range of about 50 to 100 mm Hg (abs) for a short period of time and then reducing said pressure to about 20 mm Hg (abs) or less for a period of time to reduce the moisture content to the range of about 0.5 to about 1.0%.

* * * * *